US006547588B1

(12) United States Patent
Hsu et al.

(10) Patent No.: US 6,547,588 B1
(45) Date of Patent: Apr. 15, 2003

(54) EMBEDDED TYPE CONNECTOR

(75) Inventors: Chun-Hsien Hsu, Taipei Hsien (TW); Ya-Ling Hung, Taipei Hsien (TW)

(73) Assignee: Tekcon Electronics Corp., Taipei (TW)

( * ) Notice: Subject to any disclaimer, the term of this patent is extended or adjusted under 35 U.S.C. 154(b) by 0 days.

(21) Appl. No.: 09/428,523

(22) Filed: Oct. 28, 1999

(51) Int. Cl.[7] ..... H01R 13/60; H01R 13/66
(52) U.S. Cl. ..... 439/535; 439/532
(58) Field of Search ..... 439/535, 701, 439/532, 716

(56) References Cited

U.S. PATENT DOCUMENTS 3,547,274 A * 12/1970 Sosinkski ..... 439/716
4,059,328 A * 11/1977 Rigo ..... 439/535
4,894,024 A * 1/1990 Debortoli et al. ..... 439/535
5,344,347 A * 9/1994 Inoue et al. ..... 439/701
5,380,951 A * 1/1995 Comerci et al. ..... 439/535
5,385,488 A * 1/1995 Clark ..... 439/535
6,017,250 A * 1/2000 Tsuji et al. ..... 439/701

* cited by examiner

*Primary Examiner*—Gary Paumen
*Assistant Examiner*—Ann McCamey

(57) ABSTRACT

An embedded type connector comprises a connector main body and at least one embedded socket stage. The connector main body is of hollow shape and has a bottom wall, a left wall, a right wall and a rear wall on inner sides thereof. The left wall and the right wall have two vertically extended insertion grooves and two projecting rails, respectively. The bottom wall has a plurality of terminal holes. The embedded socket stage comprises an insertion plate and a socket mounted on the plate and having a plurality of terminal holes. The insertion plate has dents on both sides thereof with separation same as the rails, The embedded socket stage is inserted into the main body with the dent fitted with the projecting rail and slides downward. In this way, the at least one embedded socket stage can be stacked within the main body.

6 Claims, 7 Drawing Sheets

EMBEDDED TYPE CONNECTOR

FIELD OF THE INVENTION

The present invention relates to an embedded type connector, especially to an embedded type connector the main body thereof having slot and projecting rail formed on the left and right walls thereof, whereby the embedded socket is stacked into the embedded type connector with the insertion plate and dent thereof fitted into the slot and the projecting rail.

BACKGROUND OF THE INVENTION

The conventional connectors are generally integrally formed with a main body and at least one socket fixedly mounted on the main body. Therefore, this kind of connectors can only be made for a specific type of plugs, such as the plug of mouse or printer. Moreover, the connectors are generally marked with a specific color for identification. However, the color of the connector can not be freely selected according to user's need.

Therefore, it is the object of the present invention to provide an embedded type connector to solve above problems.

The present invention provides an embedded type connector comprising a connector main body and at least one embedded socket stage. The connector main body is of hollow shape and has a bottom wall, a left wall, a right wall and a rear wall on inner sides thereof. The left wall and the right-wall have two vertically extended insertion grooves and two projecting rails, respectively. The bottom wall has a plurality of terminal holes. The embedded socket stage comprises an insertion plate and a socket mounted on the plate and having a plurality of terminal holes. The insertion plate has dents on both sides thereof with separation same as the rails,. The embedded socket stage is inserted into the main body with the dent fitted with the projecting rail and slides downward. In this way, the at least one embedded socket stage can be stacked within the main body. Moreover, embedded socket stage of desired color can be inserted into the main body according to user's choice, thus providing more flexibility.

The various objects and advantages of the present invention will be more readily understood from the following detailed description when read in conjunction with the appended drawing, in which:

DETAIL DESCRIPTION OF PREFERRED EMBODIMENT

Figure 1:
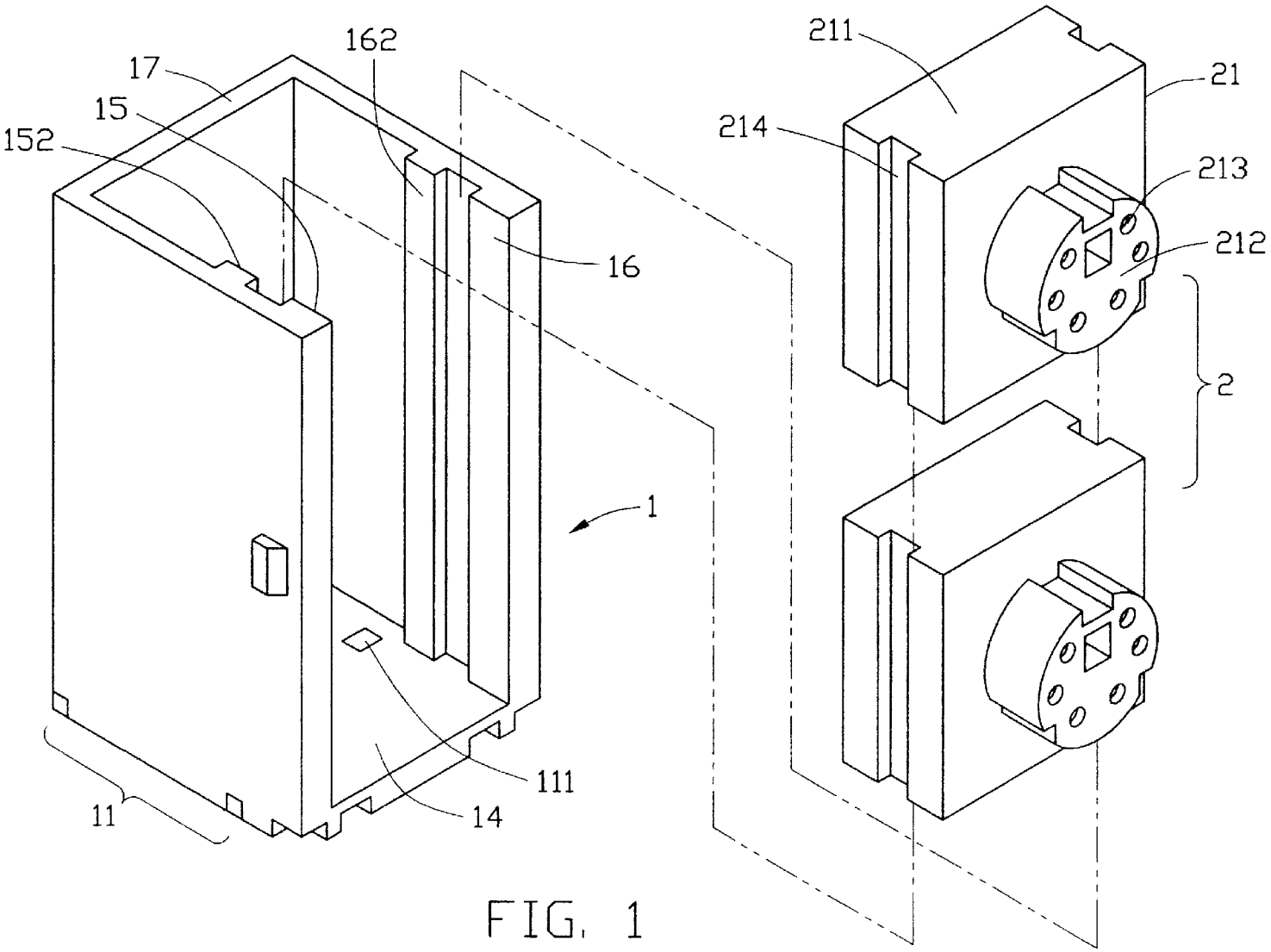
FIG. 1 is the exploded view of the first preferred embodiment of the present invention.
Figure 2:
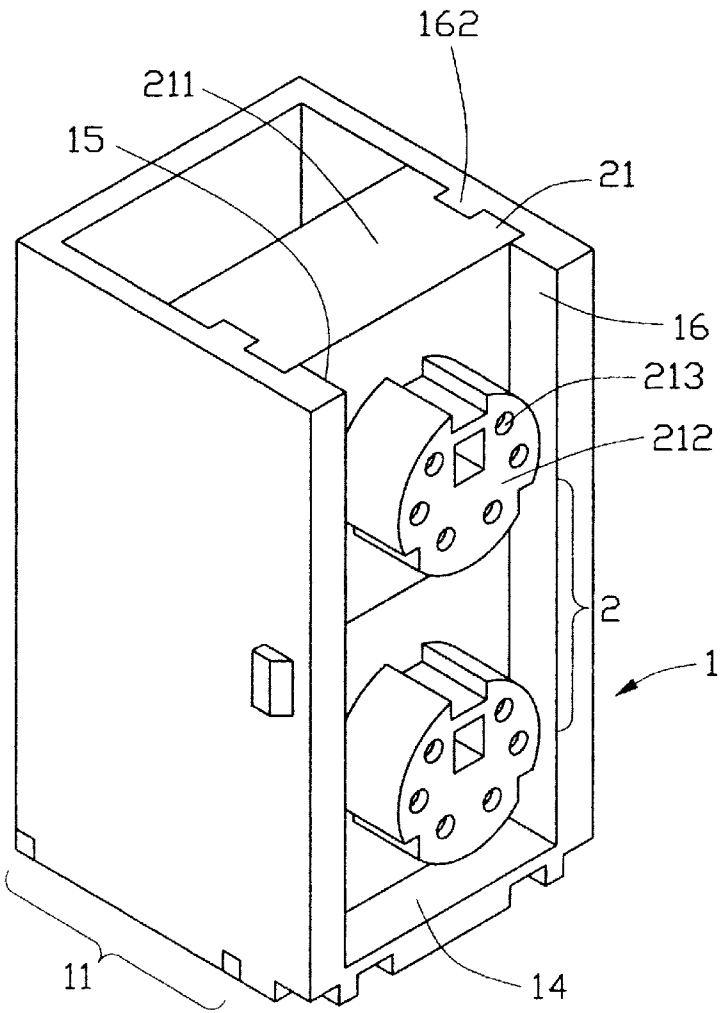
FIG. 2 is the perspective view of the first preferred embodiment of the present invention.

FIG. 1 is the exploded view of the first preferred embodiment of the resent invention, and FIG. 2 is the perspective view of the first preferred embodiment of the present invention. As shown in these figures, the embedded type connector according to the present invention comprises a main body 1 and at least one embedded connector stage 2. The main body 1 comprises a hollow rectangular frame 12 having opening on top side and front side thereof, a stable base 11 on bottom side thereof and having a plurality of terminal holes 111 thereon. Moreover, the main body 1 comprises a bottom wall 14, a left wall 15, a right wall 16 and a real wall 17 on the inner sides thereof. The left wall 15 and the right wall 16 are provided with vertically extended insertion grooves 151 and 161, and projecting rails 152 and 162, respectively. Moreover, the bottom wall 14 of the main body 1 is provided with a plurality of terminal holes 111. The embedded connector stage 2 can be a single socket stage 21 comprises a rectangular insertion plate 211 with side length about half length of the left wall 15 and a cylinder shape socket 212 formed on the front side of the rectangular insertion plate 211. The cylinder shape socket 212 has a plurality of terminal holes 213. The both sides of the rectangular insertion plate 211 are provided with two dents 214 with separation same as the two projecting rails 152 and 162. The single socket stage 21 is inserted into the vertically extended insertion grooves 151 and 161 with the two dents 214 fitted into the two projecting rails 152 and 162, whereby the single socket stage 21 slide downward and can be stacked with another single socket stage 21.

Figure 6:
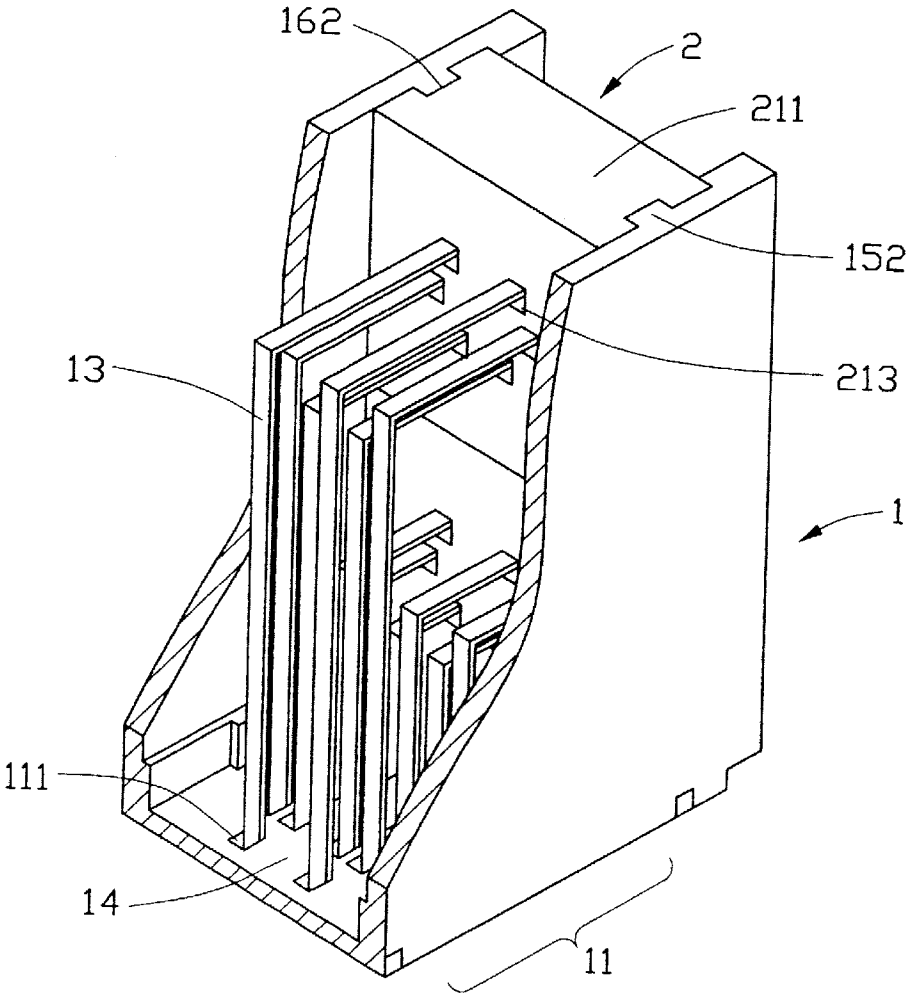
FIG. 6 is a perspective view showing the first preferred embodiment of the present invention from another viewing angle.

FIG. 6 is a perspective view showing the first preferred embodiment of the present invention from another viewing angle. As shown in this figure, the a plurality of terminals 13 are arranged into the terminal holes 111 on bottom of the base 11 and the terminal holes 213 of the embedded connector stage 2.

Figure 7:
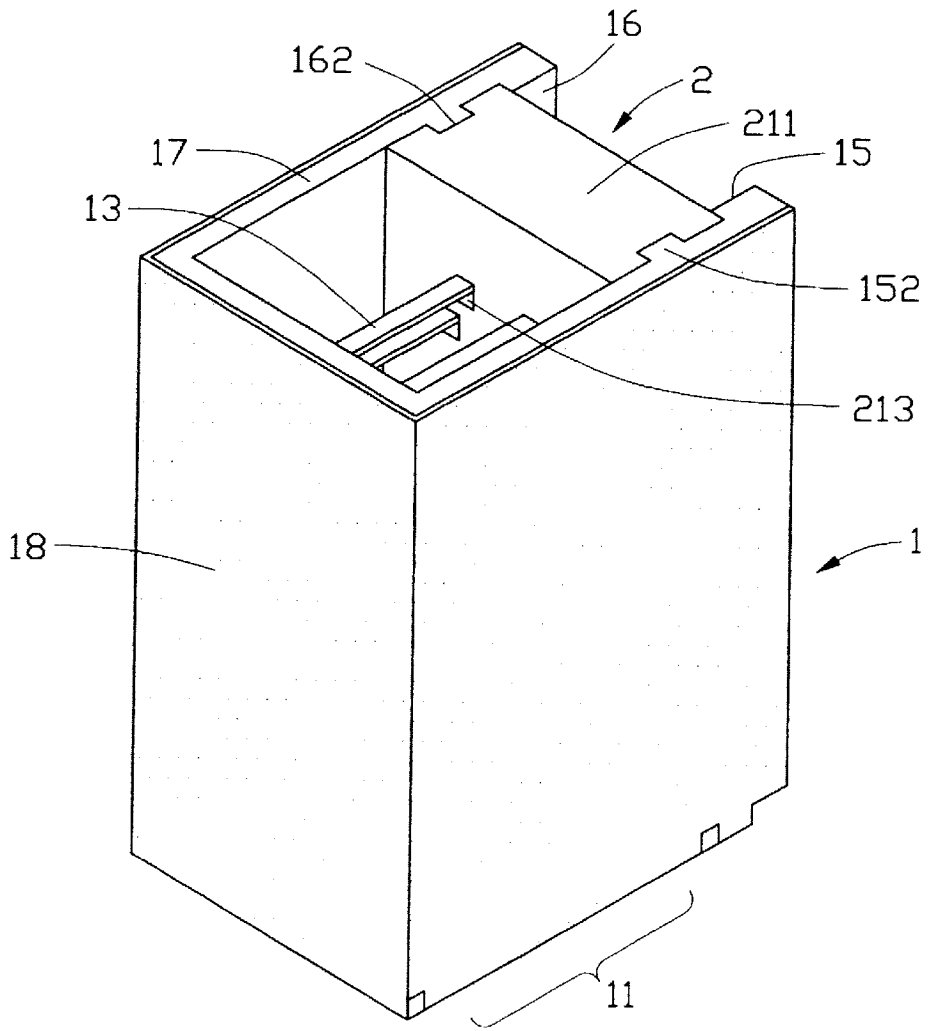
FIG. 7 is a perspective showing the connector with casing according to the first preferred embodiment of the present invention.

FIG. 7 is a perspective showing the connector with casing according to the first preferred embodiment of the present invention. The case 18 is arranged to enclose the main body 1 and can be iron case or metal case.

Figure 3:
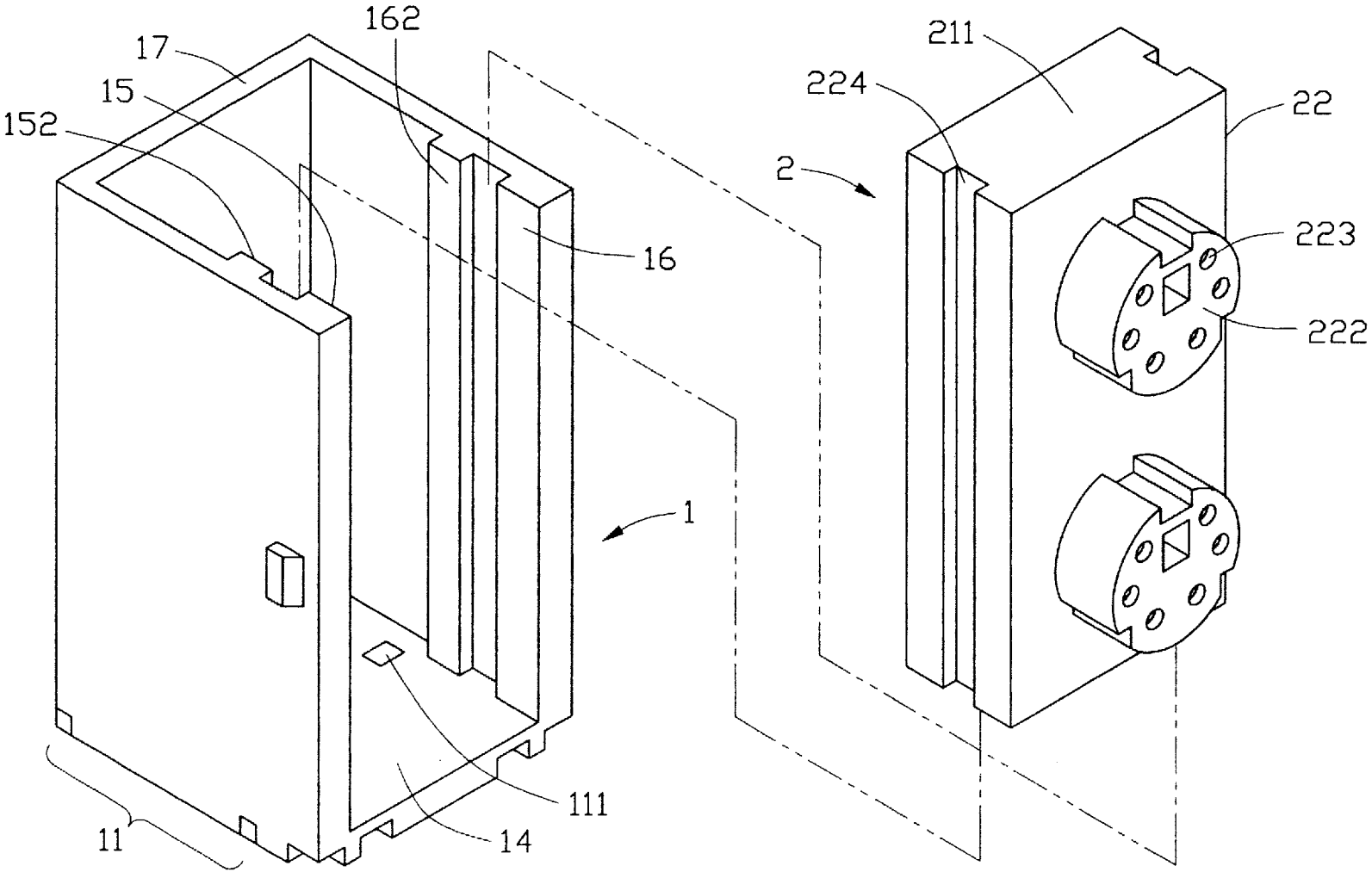
FIG. 3 is the exploded view of the second preferred embodiment of the present invention.
Figure 4:
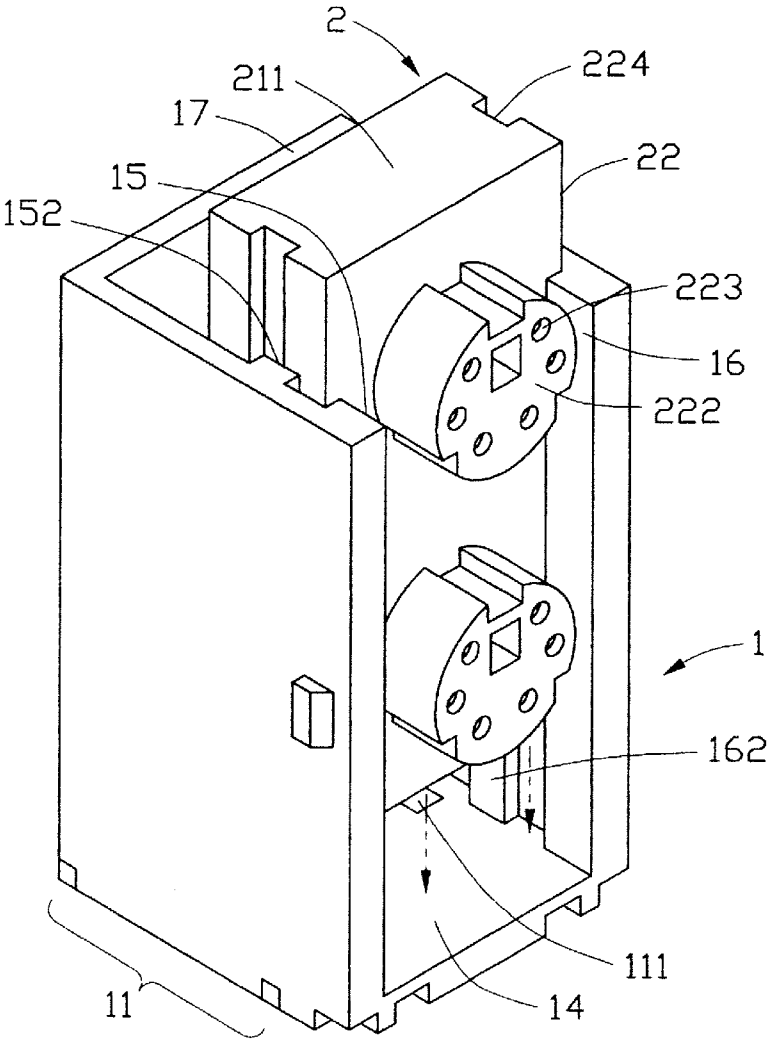
FIG. 4 is a perspective view showing the insertion process of the second preferred embodiment of the present invention.

FIG. 3 is the exploded view of the second preferred embodiment of the present invention, and FIG. 4 is a perspective view showing the insertion process of the second preferred embodiment of the present invention. In this embodiment, the embedded connector stage 2 is a dual socket stage 22 comprising a square insertion plate 221 with dimension same as the length of the bottom wall 14 and the left wall 15, and two circular sockets 222 formed on front side of the square. insertion plate 221. The shape socket 222 has a plurality of terminal holes 223. The both sides of the insertion plate 221 are provided with two dents 224 with separation same as the two projecting rails 152. The dual socket stage 22 is inserted into the vertically extended insertion grooves 151 and 161 with the two dents 224 fitted into the two projecting rails 152 and 162, whereby the dual socket stage 22 slides downward.

Figure 5:
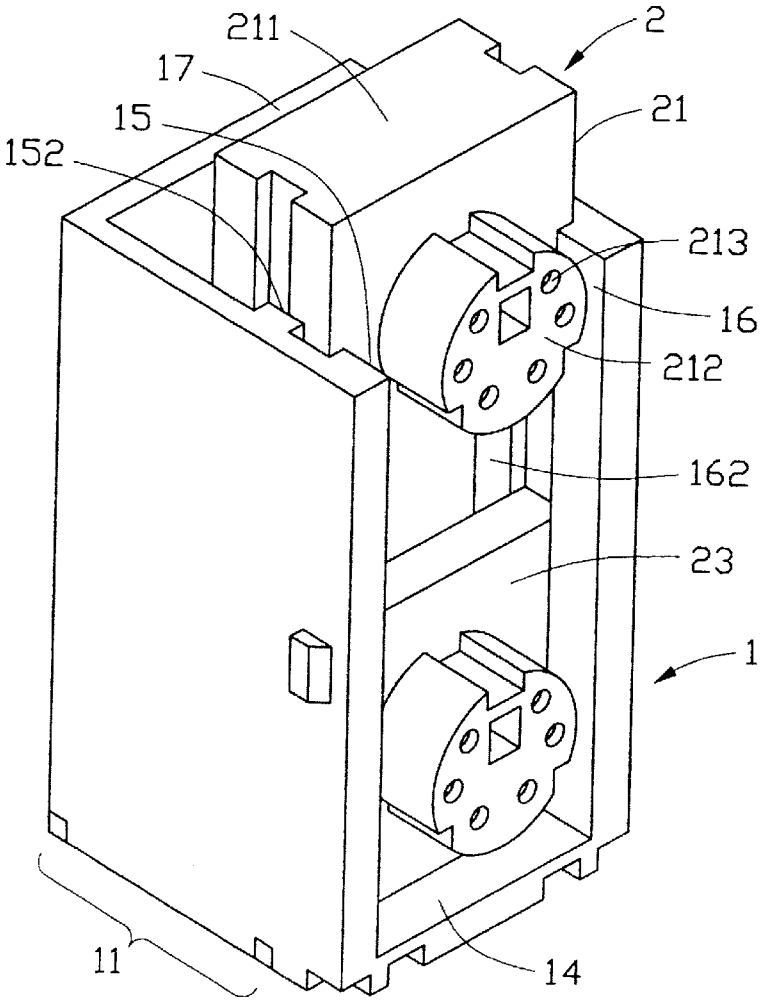
FIG. 5 is a perspective view showing the insertion process of the third preferred embodiment of the present invention.

FIG. 5 is a perspective view showing the insertion process of the third preferred embodiment of the present invention. In this embodiment, a fixedly arranged single socket stage 23 is firstly mounted on the lower end of the main body 1. Afterward, at least one embedded type single socket stage 21 is inserted and stacked on the socket stage 23.

To sum up, the inventive embedded type connector has following advantages:

1. The socket stage of the connector can be freely replaced to adapt plug of various format.

2. The socket stage can be marked with different color whereby the user can select socket stage with desired color for inserting into the connector.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. An electrical connector assembly comprising:

a bracket of a hollow shape and having a base on a bottom side thereof and a plurality of first terminal holes extending through said base, said bracket having a bottom wall formed on a top of the base, a left wall, a right wall and a rear wall, said left wall and said right wall each having a vertical rib formed on an internal surface thereof and said first terminal holes also extending through the bottom wall;

at least one connector body comprising an insertion plate, a socket connector projecting from said insertion plate, and a plurality of terminals, said socket connector and said insertion plate having a plurality of second terminal holes extending therethrough, said insertion plate having vertical recesses on both sides thereof corresponding to the ribs of the bracket, said connector body being vertically inserted into and/or removed from said bracket with said recesses slidably engaging with said ribs, the terminals having a first portion vertically extending through said first terminal holes of said base and a second portion horizontally extending in said second terminal holes of said connector body.

2. The connector assembly as in claim 1 further comprising a connector body fixed on a bottom end of said bracket.

3. The connector assembly as in claim 1, wherein a shield is provided to enclose said bracket, said shield is an iron shield or other metallic shield.

4. The connector assembly as in claim 1, wherein said connector body comprises a rectangular insertion plate with a height equal to half of a height of said left or right wall and a socket connector is formed at a front side of said insertion plate.

5. The connector assembly as in claim 1, wherein said connector body comprises a rectangular insertion plate with a height equal to a height of said left or right wall and two socket connectors are formed at a front side of said insertion plate.

6. The connector assembly as in claim 1, wherein said bracket is a hollow rectangular frame having openings at a front side and a top side thereof.

* * * * *